US007556568B2

(12) United States Patent
Ryan

(10) Patent No.: US 7,556,568 B2
(45) **Date of Patent: *Jul. 7, 2009**

(54) SPORTS EQUIPMENT SWING TRAINING APPARATUS

(75) Inventor: William Arthur Ryan, Playa-Del-Rey, CA (US)

(73) Assignee: William A. Ryan, Playa-Del-Rey, CA (US)

( * ) Notice: Subject to any disclaimer, the term of this patent is extended or adjusted under 35 U.S.C. 154(b) by 69 days.

This patent is subject to a terminal disclaimer.

(21) Appl. No.: 11/343,816

(22) Filed: Jan. 30, 2006

(65) Prior Publication Data

US 2008/0015041 A1 Jan. 17, 2008

Related U.S. Application Data

(63) Continuation-in-part of application No. 10/423,572, filed on Apr. 24, 2003, now Pat. No. 6,991,554.

(51) Int. Cl.
*A63B 69/36* (2006.01)

(52) U.S. Cl. ..... 473/226; 473/206; 473/300

(58) Field of Classification Search ..... 473/201, 473/203–206, 219, 223, 226, 227, 229, 298–303
See application file for complete search history.

(56) References Cited

U.S. PATENT DOCUMENTS 2,450,162 A * 9/1948 Promen ..... 473/212
2,984,486 A * 5/1961 Jones ..... 473/568
4,662,415 A * 5/1987 Proutt ..... 150/160
5,118,107 A * 6/1992 Bucher ..... 473/299
5,188,365 A * 2/1993 Picard ..... 473/213
5,605,509 A * 2/1997 Gray ..... 473/237
5,611,533 A * 3/1997 Williams ..... 473/568
5,865,685 A * 2/1999 Thomas ..... 473/213
5,984,795 A * 11/1999 Stafford ..... 473/206
6,036,607 A * 3/2000 Finegan ..... 473/206
6,599,200 B1 * 7/2003 Kallassy ..... 473/204
6,773,366 B2 * 8/2004 Gray ..... 473/458
6,923,727 B1 * 8/2005 Jacobs ..... 473/206
6,984,184 B2 * 1/2006 Gray ..... 473/458
6,991,554 B2 * 1/2006 Ryan ..... 473/226

* cited by examiner

*Primary Examiner*—Nini Legesse
(74) *Attorney, Agent, or Firm*—DeWitt, Ross & Stevens; Joseph T. Leone

(57) ABSTRACT

A golf swing training apparatus is disclosed. The invention includes a harness for use in connection with a bifurcated training apparatus having two operative elements, including an upper grip portion and a lower slide portion, the portions configured to be cooperatively engaged both with a golf club and each other in a defined cooperative manner. When assembled in the preferred truncated frustoconical structure, the lower slide portion is axially slidable along a length of golf club handle to assist the golfer to learn a desired swing position. An upper grip portion is secured about the golf club handle, whereby when the upper grip portion is assembled to the club handle and shaft, and a plurality of fingers of the golfer's left hand overlays a portion of the upper grip portion, those two to three fingers of the left hand substantially engaging and gripping upper grip portion during all stages of the golf swing, whereby the upper grip portion and lower slide portion are brought into full engaged position at about the point of contact of the golf club and the golf ball.

19 Claims, 6 Drawing Sheets

Fig 1
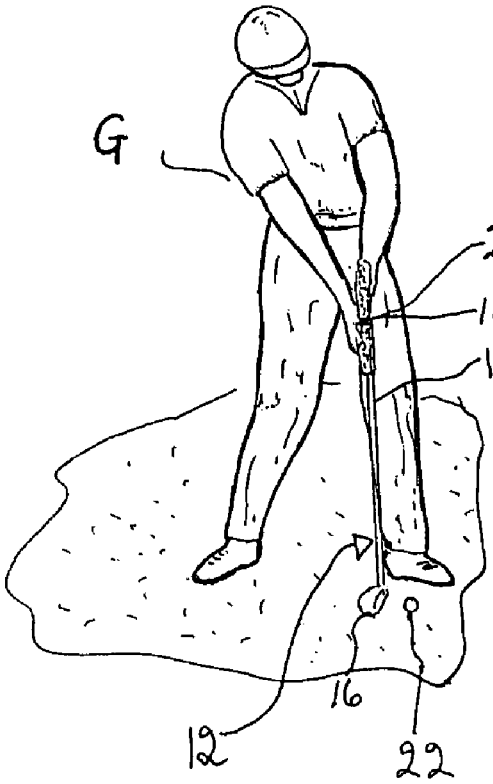
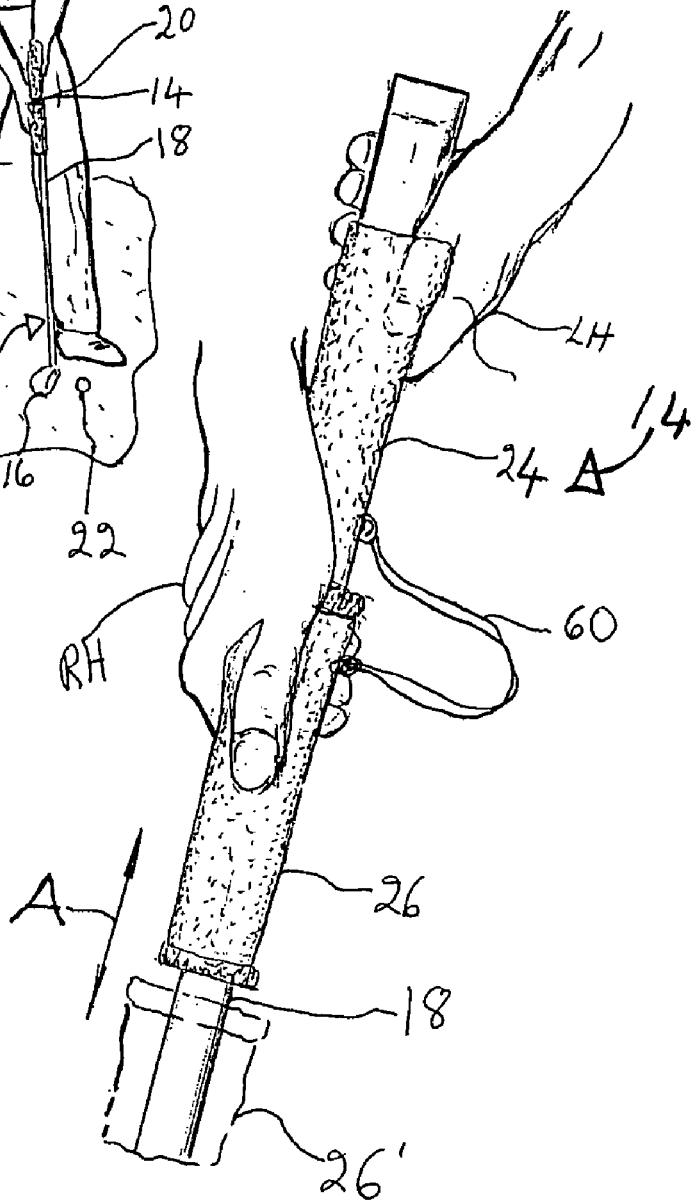
Fig 2

26
28
30
34
4
4
32
26
27
30
28
34

25

34
26
32

34
7
7
26
29
28
30
32
26
29
27

44
40
46
48
42

SPORTS EQUIPMENT SWING TRAINING APPARATUS

CROSS-REFERENCE TO RELATED APPLICATIONS

This application is a continuation-in-part of application Ser. No. 10/423,572, filed on Apr. 24, 2003 (now U.S. Pat. No. 6,991,554, issued Jan. 31, 2006).

STATEMENT RE: FEDERALLY SPONSORED RESEARCH/DEVELOPMENT not applicable

REFERENCE TO MICROFICHE APPENDIX not applicable

BACKGROUND OF THE INVENTION

1. Field of the Invention

The present invention relates to the field of sports equipment and more particularly, to a method of and apparatus for a training aid for improving the swing of a piece of sports equipment, including but not limited to golf clubs.

2. Description of the Related Art

The game of golf requires the use of a variety of different types of golf clubs, and hence different swings, including driving, chipping and putting. Proper execution of the swing for each club requires the specific recollection and dynamic application of a separate sequence of steps. For example, in driving a golf ball, a golfer is typically instructed to keep his/her feet approximately shoulder width apart, back straight, knees flexed, elbows in, and head down during set-up; to keep his head still as he rotates his shoulders, shifts his weight to his back foot and bends his arms only slightly, if at all, at the elbow as he draws the club back to the top-of-swing position; and to then transfer his weight to his forward leg, followed by rotation of his hips and then following through an impact zone as he strikes the golf ball and completes the swing. For golfers at most every level of play, consistency and repeatability in achieving the desired optimal swing remains an ongoing challenge.

In view of the popularity of the golf game, a variety of devices have been devised to improve the basic golf swing. According to one example, the swing training device disclosed in U.S. Pat. No. 5,288,074 attempts to improve the golf swing by restricting the motion of the golfer's hips with relation to his shoulders, thereby increasing the differential angle between his shoulder rotation and hip-turn. That device provides a support affixed on one end to a flat base and a contoured member positioned on the support end opposite the base to receive the hips of the golfer and pivot along a defined horizontal plane to limit the movement of the golfer's hips during a golf swing. An important constraint in this and similar devices is the requirement of external apparatus for training the golfer in developing his swing, and the training device is neither portable nor usable during training and practice on the golf course.

According to another example of a swing training device, the Kallassey swing trainer attempts to improve the golf swing by providing a training aid in the form of a golf club having a sliding grip portion to be gripped by the golf student. However, sliding grip portion is fixed to the training club (limited to a number five iron) such that it is not usable with the golfer's own golf equipment (whether a wood, iron, or putter), thereby preventing the golfer from perfecting his swing based on the "feel" of his own equipment. Another important limitation is the restriction by design from use of that training device in an actual sports arena for non-regulation play training purposes. Yet a further important limitation is the restriction by design from use of that training device in a retrofittable capacity.

Thus, none of the devices in the related art discloses a golf swing training device which moves with the golfer throughout his golf swing to make him aware of his hand and body position at each point of his swing, and simultaneously allows the golfer's hips to make a lateral move towards the target area during the downswing and follow through, yet which also allows for complete portability of the training device. Moreover, none of the prior art devices known to me provide a golf swing trainer which is usable by retrofit with all of the golfer's clubs, without limitation to the location of use (on the golf course, driving range, or off site). Additionally, none of the related art devices disclose such a golf swing trainer which is removably affixable to any golf club (or other sporting equipment requiring training of a repeatedly effective service swing) that enables the golfer to repeat his golf swing quickly and easily to develop his golf swing memory. In like manner, none of the related art devices enable the golfer to practice each of the different swings in his golf game, including driving, chipping, and putting, by providing muscular and tactile feedback. Indeed, most every one of the related art devices are specifically unavailable to the golfer when he actually engages in a game of golf.

OBJECTS AND SUMMARY OF THE INVENTION

Accordingly, it is an object of the present invention to provide a golf swing training device for developing the memory of a proper golf swing.

It is another object of the present invention to provide a golf swing training device for developing the memory of a proper golf swing, usable for training with every golf club a golfer uses in his/her game so that each swing is naturally and consistently repeated when he engages in actual play.

It is a further object of the present invention to provide a golf swing training device for developing the memory of a proper golf swing, the device useable for training purposes on or off the golf course.

It is yet another object of the present invention to provide a swing training device that is readily retrofittable to any shaft-based sporting equipment, for use in developing the memory of a desired swing, the device useable for training purposes on or off the sporting arena.

It is yet a further object of the present invention to provide a swing training device that in the fully installed position, enables the golfer to achieve the desired golf grip at all phases of the golf swing.

These and other objects are achieved, according to the present invention, by use of a bifurcated training apparatus the swing training apparatus having two operative elements, including an upper grip portion and a lower slide portion, the portions configured to be cooperatively engaged both with a golf club and each other in a defined cooperative manner. When assembled in the preferred truncated frustoconical structure, the lower slide portion is axially slidable along a length of golf club handle to assists the golfer to learn a desired swing position. An upper grip portion is secured about the golf club handle, whereby when the upper grip portion is assembled to the club handle and shaft, optionally one or more fingers of the golfer's left hand overlays a portion of the upper grip portion, to optionally assist in engaging and gripping the upper grip portion during one or more stages of the golf swing. When used according to instruction, as the golf club is swung into the impact zone, the upper extent of the lower slide portion engages in overlapping, telescoping fashion with the lower portion of the upper grip portion, while the golfer completes his swing, the inventive apparatus thus teaching a preferred pendulum-type swing. A further improvement of the invention includes a harness for linking the golfer's arms in a manner that facilitates a coordinated golf swing, utilizing the bifurcated training apparatus. Alternatively, the harness may be utilized independently of the interengaging grip and slide portions, to simulate a golf swing as desired for instructional purposes.

The above objects and description together with other objects and description of the invention, along with the various features of novelty which characterize the invention, are pointed out with particularity in the claims annexed to and forming a part of this disclosure. For a more complete understanding of the present invention, its performance, structural and operating advantages and the specific objects attained by its uses, reference shall be made to the accompanying drawings and description in which there are presented exemplary preferred embodiments of the invention.

BRIEF DESCRIPTION OF THE DRAWINGS

FIG. 1 is a perspective view of a golfer holding a conventional golf club, to which is secured for training purposes the swing training apparatus of the present invention, the golfer further shown swinging his club through the impact zone during which time the club head is directed to impact and drive a golf ball.

FIG. 2 is a perspective view of the swing training apparatus of the present invention, shown secured for training purposes on the shaft of a regulation golf club, the apparatus further shown in the fully contracted position at about the moment of impact in the impact zone by the golfer shown in FIG. 1, whereby the lower slide portion is maximally engaged with the upper grip portion.

DETAILED DESCRIPTION OF THE PREFERRED EMBODIMENTS

Figures 3, 4, 5, 6, 7:
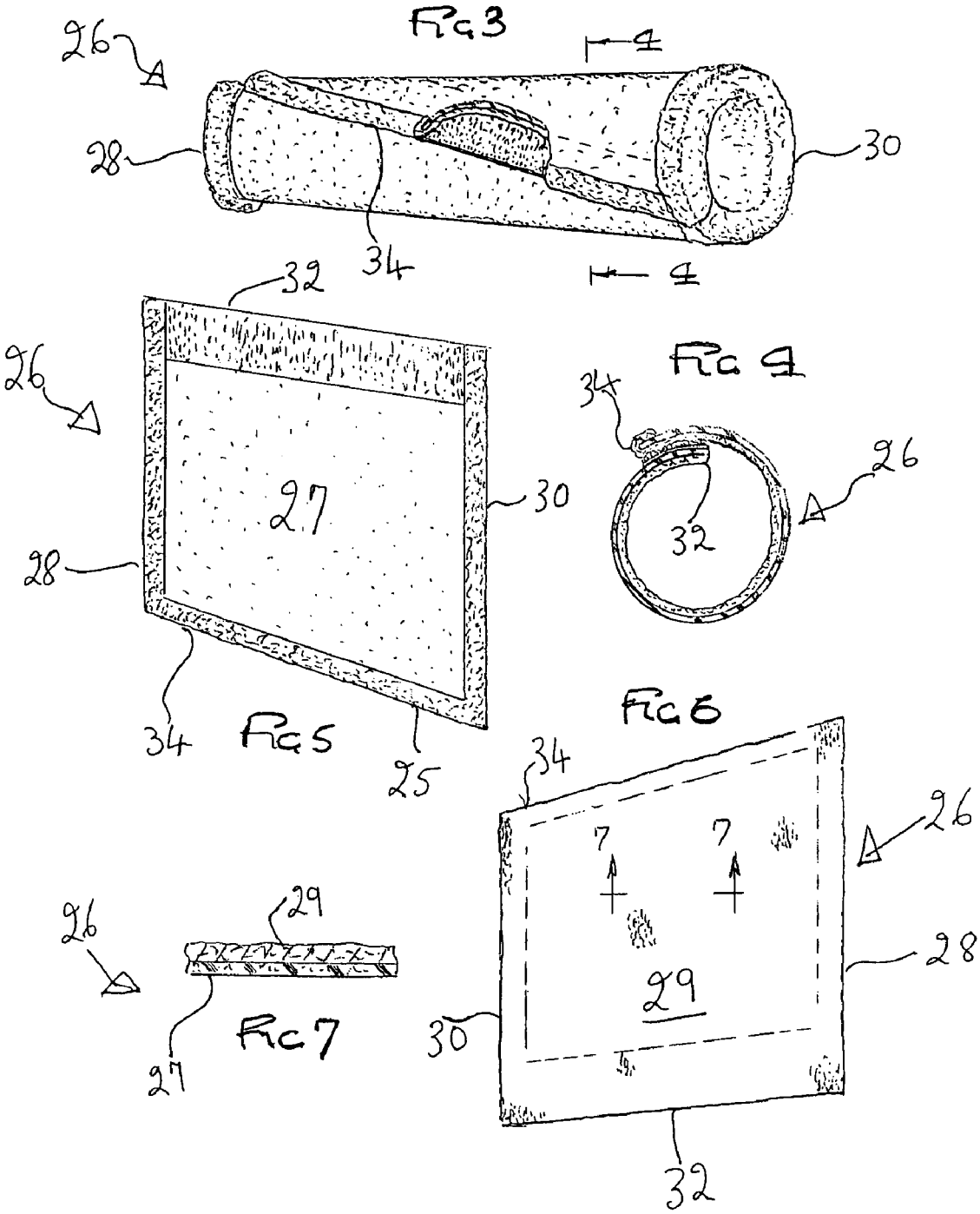
FIG. 3 is a perspective view of the lower slide portion of the swing training apparatus shown in FIG. 2, further showing a partial cutaway section in which additional features of the lower slide portion are shown, including a selectively secured self-engagement feature for securing together opposing edges of the lower slide portion at a bias to the longitudinal axis of the golf club shaft to which it is removably secured.
FIG. 4 is a cross-sectional view of the lower slide portion shown in FIG. 3, taken along line 4-4 of FIG. 3.
FIG. 5 is a planer view of the inside surface of the lower slide portion shown in FIGS. 3 and 4 in the unfurled condition prior to be secured about a golf club shaft.
FIG. 6 is a planer view of the outside surface of the lower slide portion shown in FIGS. 3 and 4, the obverse side shown in FIG. 5, in the unfurled condition prior to be secured about a golf club.
FIG. 7 is a cross-sectional view of the section taken along line 7-7 of FIG. 6.

Referring now to the drawings wherein like numerals designate like and corresponding parts throughout the several views, and according to a first embodiment of the present invention, FIG. 1 shows a perspective view of a golfer G holding a conventional golf club 12, to which is secured for training purposes the swing training apparatus 14 of the present invention, the golfer G further shown swinging the golf club 12 through an impact zone during which time the club head 16, mounted to a club shaft 18 extending from a club handle 20 is directed to impact and drive a golf ball 22. It will be appreciated that golf club 12 may be a wood, iron, or putter as may be used in accordance with the teachings of the present invention, as necessary and desired to assist in the training of the desired golf swing.

With reference now to FIG. 2, the swing training apparatus 14 of the present invention includes two operative elements, including an upper grip portion 24, with a perspective view thereof shown in FIG. 8, and a lower slide portion 26, with a perspective view thereof shown in FIG. 3, the portions 24, 26 configured to be cooperatively engaged both with a golf club and each other in a defined cooperative manner as more fully described below. Specifically, and with reference now to FIGS. 3-7, lower slide portion 26 is fabricated from a section 25 of a flexible sheet material having a generally rectilinear configuration bounded by a first pair of two parallel sides 28, 30, and a second pair of non-parallel connecting sides 32, 34. When assembled in the truncated frustoconical structure shown in FIG. 3, the so formed section 25 encompasses, and is axially slidable along, a length of golf club handle shaft 18, such that connecting side 34 overlaps connecting side 32 at a seam offset from the longitudinal axis of the golf club shaft 18. This seam, it has been discovered, assists the golfer G in aligning his right hand RH in a desired swing position. In that configuration, each of connection sides 28, 30 is wrapped about itself to form an end ring substantially concentric about the club shaft 18, yet provides a tapered construction having its larger end (defined by the end ring constructed from connecting side 30) configured to overlap a downwardly extending portion of upper grip portion 24 in the manner to be more fully described below, and its lower end having its smaller end (defined by the end ring constructed from connecting side 28) forming the forward end to be slidable along the golf club shaft 18 during use.

Section 25 from which the lower slide portion 26 is fabricated has an inner face 27 (FIG. 5) having a relatively low coefficient of sliding friction for slidably engaging with club shaft 18. Such surface material may be a nylon or spandex-type finish or fabric which is amenable to biaxial stretching during installation, removal, and use of the training device of the present invention. However, outer face 29 (FIG. 6) has a surface with a textured or other grippy finish to enable golfer G to easily and reliably grip lower slide portion 26 through all stages of the golf swing. Such surface material may include neoprene, pseudo-sharkskin skin, or other textured surface necessary and desirable to provide the desired level of grip, as well as compensating for external agents such as water or perspiration as may compromise a secure grip during use.

Figure 8:
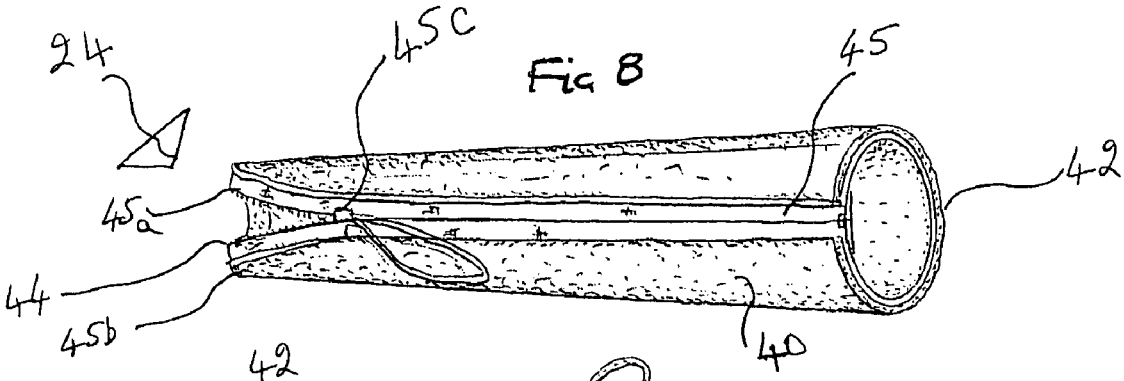
FIG. 8 is a perspective view of the upper grip portion of the swing training apparatus shown in FIG. 2, including a selectively secured self-engagement feature for securing together opposing edges thereof, a portion of which is to be secured about a handle installed on the golf club shaft.

Now referring to FIG. 8, upper grip portion 24 is fabricated from a section 40 of a flexible sheet material having a generally rectilinear configuration bounded by a first pair of two parallel lower and upper edges 42,44, and a second pair of non-parallel connecting sides 46, 48, which are removably joined by a zipper 45. Zipper 45 is comprised of two strips of tape 45*a*, 45*b* each secured to connecting sides 46, 48, respectively and secured together by a slider body 45*c* in the conventional manner. Slider body 45*c* is operated by loop-type handle 45*d*. Furthermore, zipper 45 may have a top tape extension (open, closed, looped, or bridged) extending upwardly to provide alignment benefits in the manner to be more fully described. Alternatively, other securement means may be employed without departing from the scope and spirit of the present invention and as recited in the claims appended hereto, including but not limited to hook-and-loop fasteners. Preferably, an additional flap-like strip of flexible material may be secured to and extending from either connecting sides 46,48 to overlap the zipper in the connected condition, thereby isolating the zipper components from the golf club shaft 18 and club handle 20 in the installed and dynamic conditions.

Figure 9:
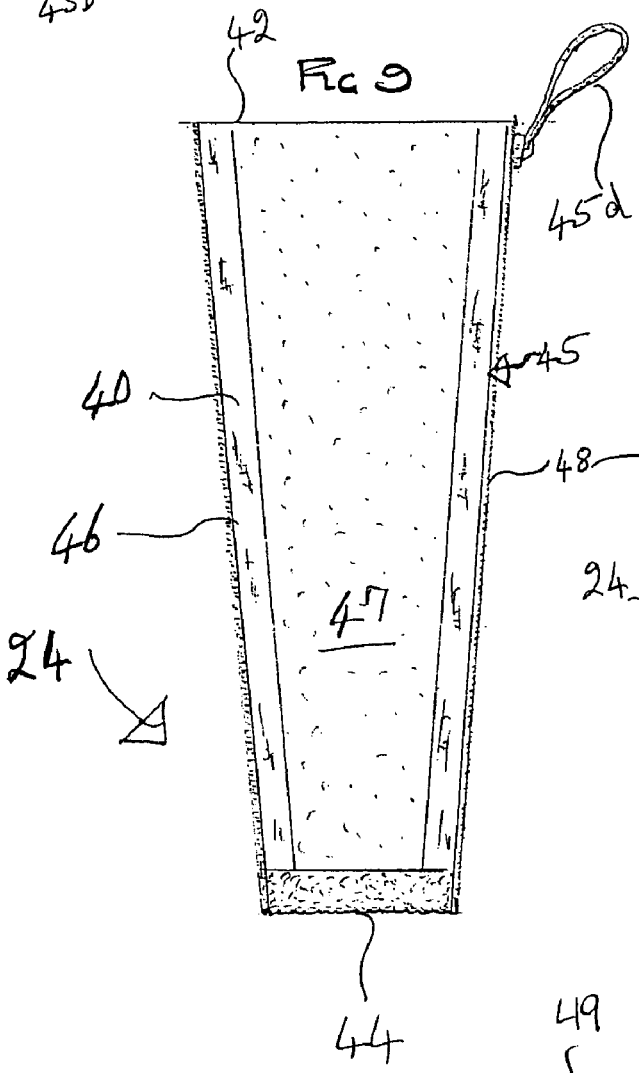
FIG. 9 is a planer view of the inside surface of the upper portion shown in FIGS. 2 and 8 in the unfurled condition prior to be secured about a golf club shaft and positioned for gripping the golf club handle relative to the longitudinal axis of the golf club shaft to which it is removably secured.
Figure 10:
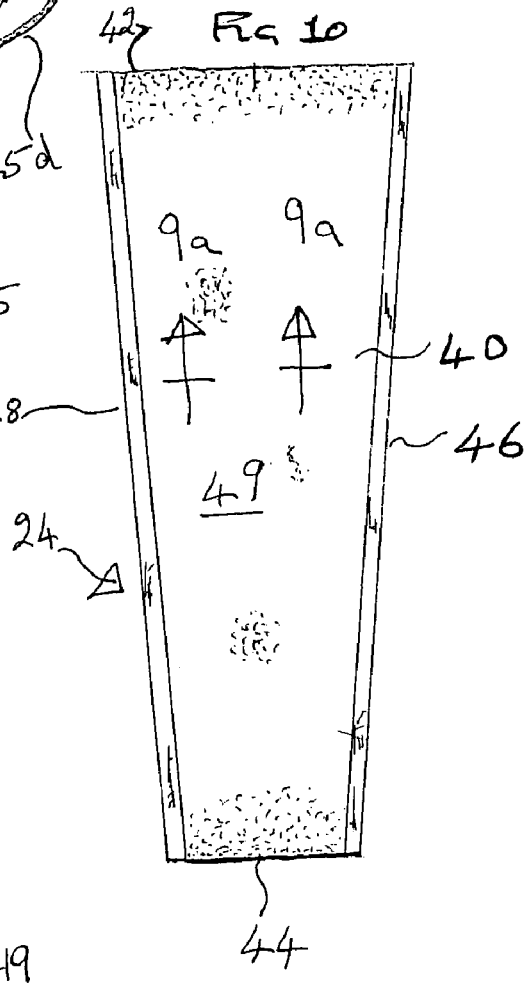
FIG. 10 is a planer view of the outside surface of the upper grip portion shown in FIGS. 2 and 8, the obverse side shown in FIG. 9, in the unfurled condition prior to be secured about a golf club shaft.
Figure 9A:
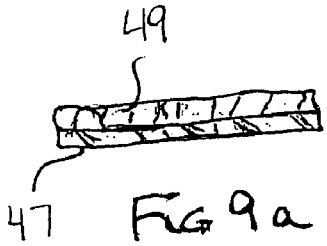
FIG. 9*a* is a cross-sectional view of the section taken along line 9*a*-9*a* of FIG. 9.

Section 40 from which the upper grip portion 24 is fabricated has an inner face 47 (FIG. 9) having a relatively high coefficient of sliding friction (i.e. "grippy") to secure it with club handle 20 in the fully installed condition on the club handle 20. As previously described, such surface material may include neoprene, pseudo-sharkskin, or other textured surface necessary and desirable to provide the desired level of grip, as well as compensating for external agents such as water or perspiration as may compromise a secure grip during use, as well as to secure the golfer's thumb in place in desired gripping placement in the manner to be more fully described below. In contrast, outer face 49 (FIG. 10) has a relatively low coefficient of friction to allow sliding in the manner described above in connection with inner face 27 of the slide portion 26, utilizing the same or similar nylon or spandex material as described for the obverse side.

Accordingly, when assembled in the truncated frustoconical structure shown in FIG. 8, the so formed section 40 encompasses in telescoping, overlapping fashion an axial length of golf club handle shaft 18 and handle 20, whereby the ring-like structure formed from edge 42 extends to an intermediate extent of club handle 20, and the opposite edge 44 forming a concentric ring-like structure extends to an intermediate axial extent of shaft 18. In this installed condition, zipper end extends upwardly, and is positioned outwardly on the club handle 20, whereby when the upper grip portion 24 is assembled to the club handle 20 and shaft 18, optionally one or more fingers of the golfer's left hand LH may overlay a portion of the upper grip portion 24, to optionally engage and grip the upper grip portion 24 during one or more stages of the golf swing. Concurrently, the thumb of left hand LH is inserted in a concavity provided between the concentric ring formed from edge 42 and underlying club handle 20 during training use, thereby allowing golfer G to securely grip the upper grip portion 24 to the golf club 12 during use, which is to say that the hand is now secured in position by the inward biasing of the gripping portion against the thumb. It will be appreciated that either or both of the gripping portion and sliding portion may be fabricated of relatively flexible material or a material in which the portion is maintained in a fixed structure (e.g. for the gripping portion, a fixed structure providing access for the golfer's thumb, but not limited thereto). In use, the outer surface of the grip portion slidably engages with the opposing inner surface of the slide portion with relatively low overall friction to minimize distraction to the golfer while practicing the desired golf stroke. Further, the gripping portion may be used independently of the slide portion, the gripping portion providing the thumb constraining function as described above to enhance training of correct thumb positioning as part of the golf stroke.

Concurrently, golfer G uses his right hand RH to grip lower slide portion 26, which is slidable along club shaft 18 in the direction of arrow A (FIG. 2). According to the invention, and the method thereof, golfer G may initiate the golf swing by maintaining his grip on the lower slide portion 26 during his back swing (allowing it to slide toward the lower end of the club), while retaining his left hand LH in the static gripping manner described. Upon initiating his down swing, golfer G swings the club 12 in the prescribed manner into the impact zone while concurrently sliding the lower slide portion 26 upwardly along the club shaft 18. When used according to instruction, as the club 12 is swung into the impact zone, the upper extent of the lower slide portion 26 will engage in overlapping, telescoping fashion with the lower portion of the upper grip portion 24, and preferably becomes fully engaged at a dead stop at the point of impact of the golf club head 16 and golf ball 22.

According to the invention, the material of construction provides the necessary and desired stretchability for thumbs of different sizes. Alternatively, longitudinal edges of the gripping portion may be secured with a securing means such as cooperating strips of hook-and-loop material secured to the grip portion at opposing longitudinal edges thereof, or inserts of stretchable material at that region to accommodate the thumb of the left hand LH or right hand. Zipper 45 may extend substantially the entire length or a portion thereof of the upper grip portion 24, having an overall assembled length according to one embodiment of about 8 inches, although variations on overall length, as well as thickness of material 40 and even zipper tab length may be made to provide specific performance benefits. It is further contemplated that either or both portions 24, 26 may be provided in a selection of sizes and lengths (with or without coordinated sizing) to accommodate golfers with different grip sizes. It will be appreciated that the upper gripping portion 24 must be dependably secured (as by tightening as described above) to enable the golfer G to perform precisely and repeatedly, such that the learned swing motion achieved by the present invention is repeatable in use. Furthermore, the portions 24, 26 may be tethered by a cord or lanyard 60 (FIG. 2) to allow the golfer G to release his grip from the slide portion, or, to minimize the possibility of loss of one portion or to allow for storage as by hanging. Alternatively, the cord or lanyard 60 may be provided with particular length or elasticity to limit swing motion, or to provide advance notice to the golfer G as his swing reaches a predetermined extension.

According to another embodiment of the present invention, it is contemplated that the lower slide portion 24 may include finger recesses or even be provided in the form of a partial or full glove that is likewise constrained for sliding motion along the club shaft 18, thereby actively securing the golfer's right hand RH to the alternate restraint during use of this alternate embodiment, and further as described in connection with FIG. 11*a*. It will be noted that the designation of right hand and left hand as herein described may be alternated for golfers having the associated swing.

Figure 11:
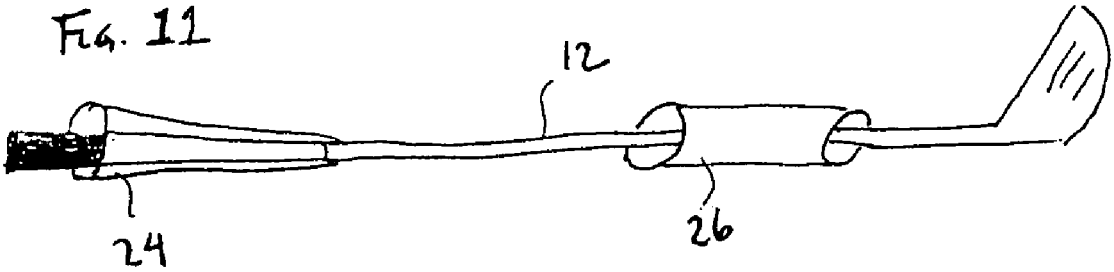
FIG. 11 is an elevational view of the swing training apparatus of the present invention, showing the sliding portion and gripping portion secured for training purposes on the shaft of a regulation golf club, the sliding and gripping portions further shown in an extended position as may be adopted at a golfer's portion other than at about the moment of impact as shown in FIG. 1.
Figure 11A:
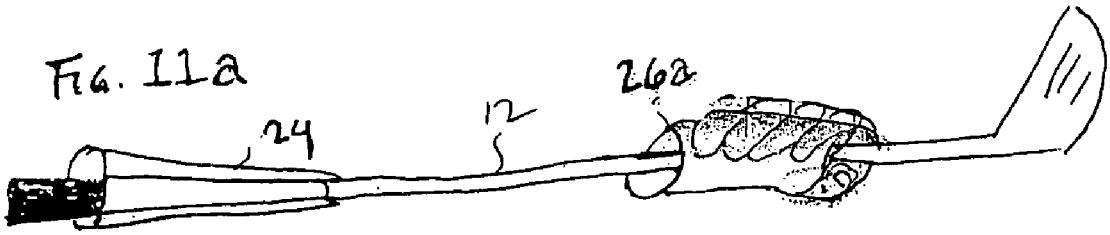
Figure 12:
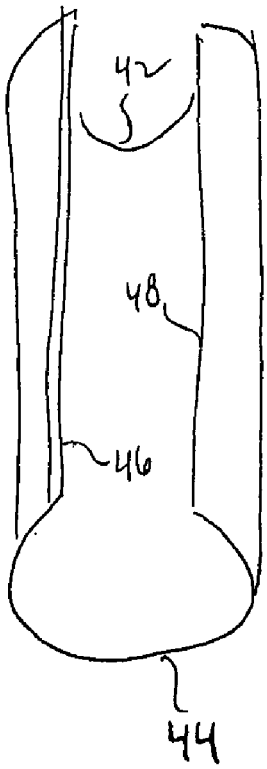
FIG. 12 is a perspective view of the slider portion of the swing training apparatus, shown in a partially furled condition.
Figure 13:
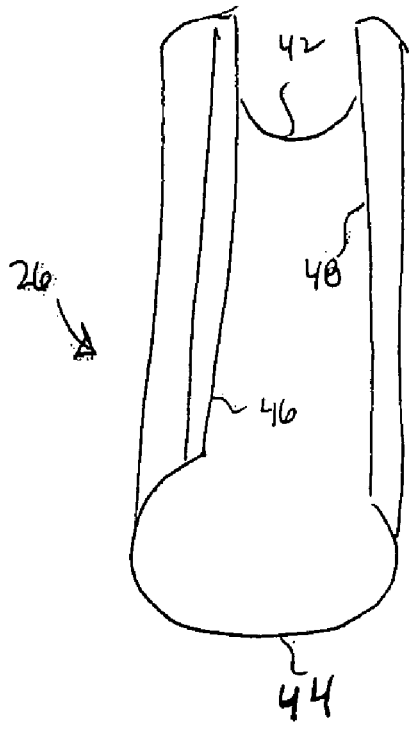
FIG. 13 is a perspective view of the gripping portion of the swing training apparatus, shown in a partially furled condition.

With reference now to FIG. 11, the swing training apparatus of the present invention, shows golf club 12 to which is fitted sliding portion 26 and gripping portion 24 secured for training purposes in the manner previously described. As shown, the sliding and gripping portions 26, 24, respectively are shown in an extended position as may be adopted at a golfer's portion other than at about the moment of impact as shown in FIG. 1. Furthermore, and according to a further embodiment of the present invention, it is contemplated that the apparatus of the present invention may be fabricated as a one-piece unit without a lateral joining means as with a zipper or the like as previously described, that is, a sliding portion which when advanced toward the club handle as shown by arrow A in FIG. 2 may be further advanced to overlap the handle and optionally at least one of the golfer's fingers (typically a thumb but not limited thereto) to also serve as a gripping portion in the manner previously described. To achieve this, the one-piece unit is fabricated of a relatively thin-sheet stock material that is readily stretched to accommodate this overlapping and dual feature. Alternatively, and with reference now to FIG. 11*a*, slide portion 26*a* is provided in a glove-like structure for receiving part or all of the golfer's sliding hand, and it will be appreciated that slide portion 26*a* may be used either alone or in combination with gripping portion 24. Furthermore, it will be appreciated that glove-like slide portion 26*a* may be fabricated either to be sheath-like as described above, or with a zipper or other joining method as described in connection with the embodiment shown and described in connection with FIGS. 3-7.

Figure 14:
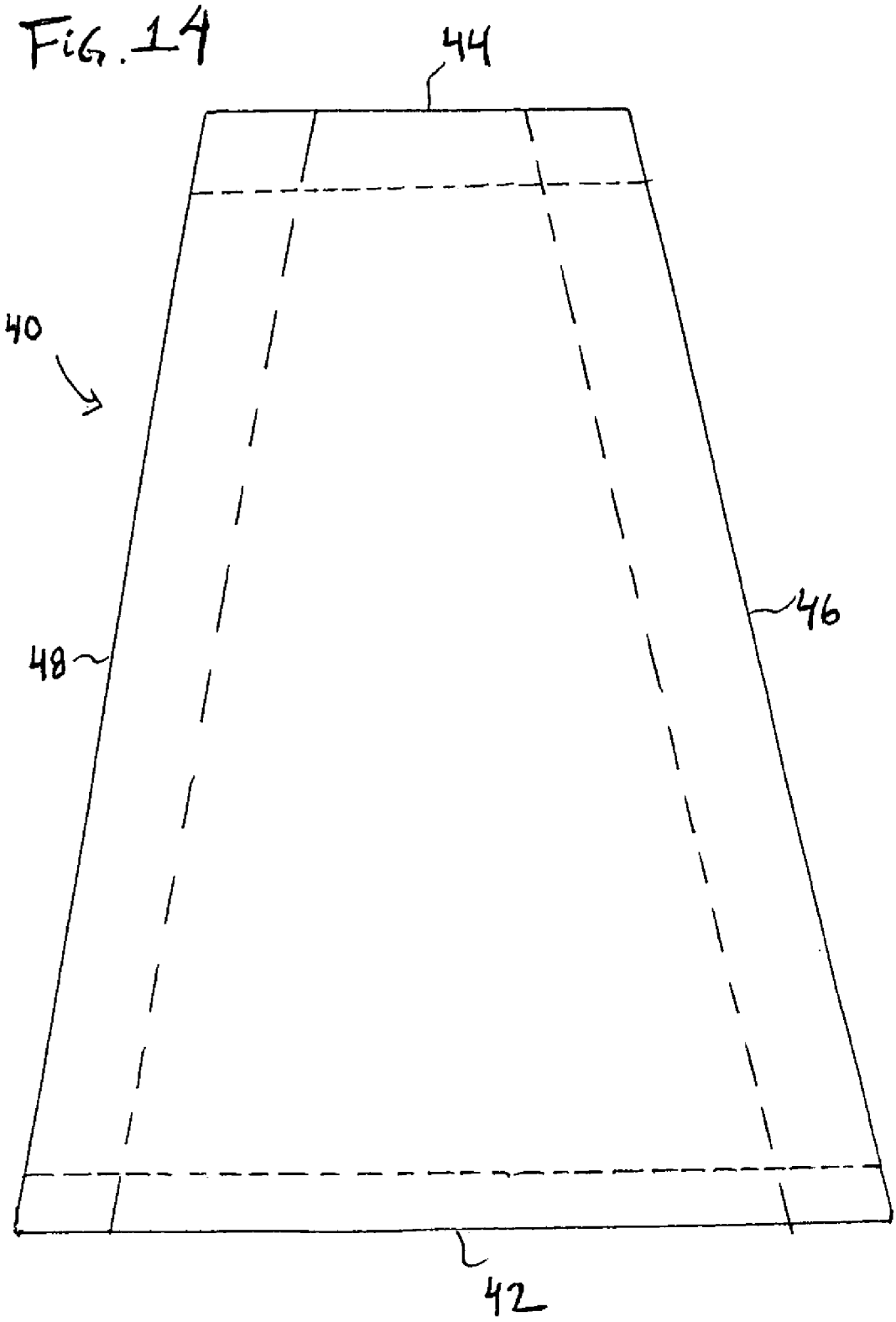
FIG. 14 is a perspective view of the gripping portion or slide portion of the swing training apparatus, shown in an furled condition.

With reference now to FIG. 14, section 40 may alternatively have a regular upright shape from which the upper grip portion 24 and lower slide portion 26 is fabricated. Section 40 has an upper edge 44 with a width of about three inches (3") although that width may be increased or decreased as desired to accommodate club shafts having larger or smaller diameters. Lower edge 42 has a width of about six inches (6") although that width may be increased or decreased as desired to accommodate club grips having larger or smaller diameters, as well as to receive a golfer's thumb in the manner previously described. Edges 46, 48 have length of about 7.5 to 8 inches although that length may be increased or decreased as desired to accommodate club shafts of longer or shorter dimension, for tall or short players.

Figures 15, 16:
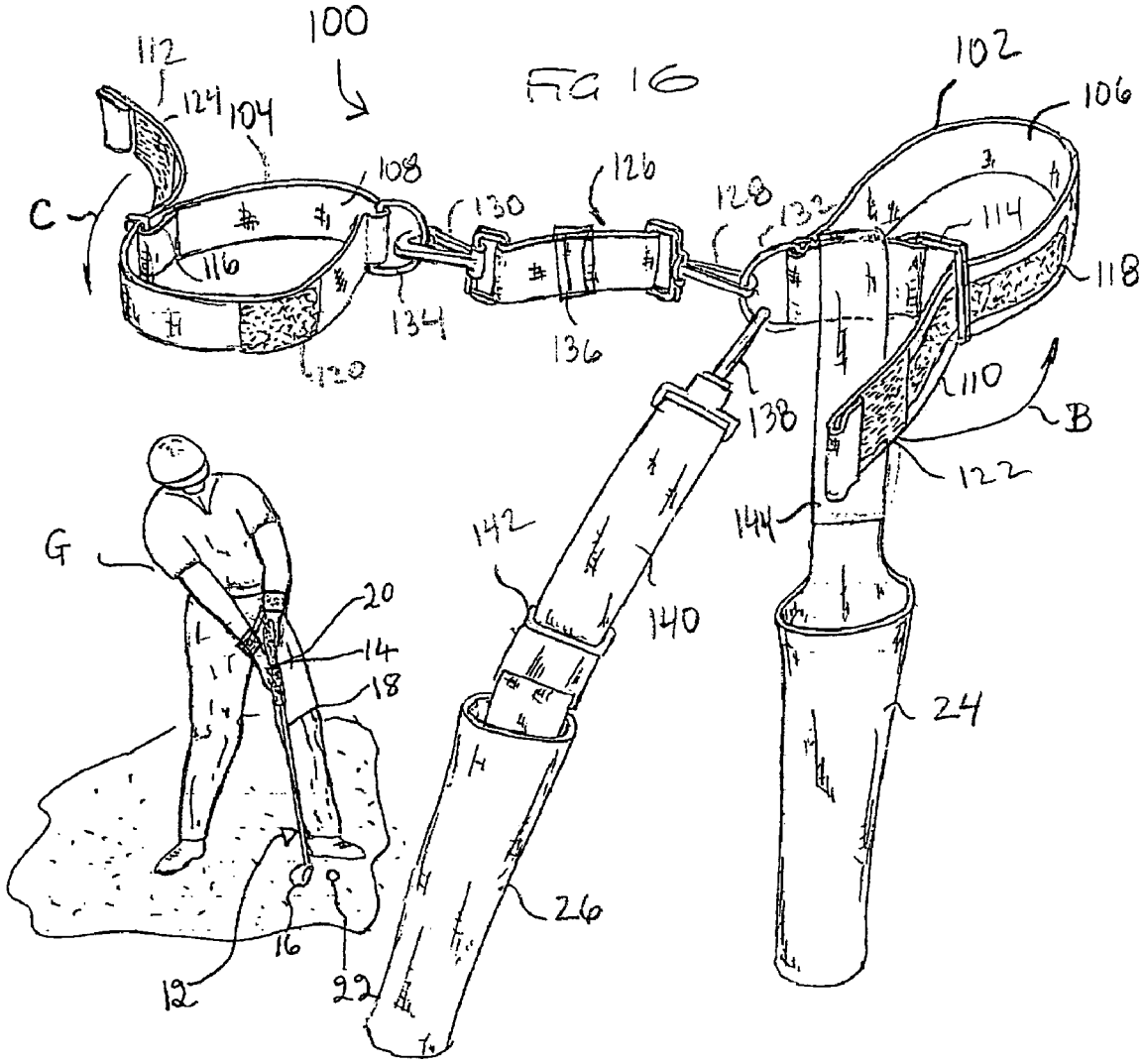
FIG. 15 is a perspective view of a golfer holding a conventional golf club, to which is secured for training purposes the swing training apparatus of the present invention further including a harness for linking the golfer's arms in a manner that facilitates a coordinated golf swing, utilizing the bifurcated training apparatus of the interengaging grip and slide portions.
FIG. 16 is an enlarged perspective view of the swing training apparatus of the present invention shown in FIG. 15, for attachment to the golfers left and right arms/wrists, to be secured for training purposes on the shaft of a regulation golf club.

With reference now to FIGS. 15-16, a further improvement of the invention includes a harness 100 for linking the golfer's arms in a manner that facilitates training of a coordinated golf swing, utilizing the bifurcated training apparatus including the upper grip portion 24 and lower slide portion 26 in the manner previously described. Specifically, harness 100 includes a left arm portion 102 and a right arm portion 104. As more fully described below, it will be understood that the term "arm portion" may be affixed to the golfer's wrist, lower arm, or upper arm depending on the selected training technique. Each arm portion 102, 104 includes a flexible web portion 106, 108, respectively, having leading edge tabs 110, 112 extending through buckles 114, 116 and then doubled back in the direction of arrows B and C, respectively on the respective web portion 106, 108 and each secured with a fastener such as cooperating securing portions 118, 120, 122, 124 of hook-and-loop material. Flexible web portions 106, 108 are joined by a center strap 126 having hook portions 128, 130 for being releasably joined to cooperating loop portions 132, 134 supported by web portions 106, 108, respectively. The length of the center strap 126 may be adjusted at adjuster 136 for cinching or releasing a length of material comprising center strap 126, to accommodate golfers of different sizes and relative arm positioning. Lower slide portion 26 is releasably secured to the selected arm portion 102, 104 at loop portion 132, 134 by hook portion 138 supported by grip strap 140, the assembly depending on whether a right-handed or left-handed swing is being taught. Further the grip strap 140 may be selectively lengthened or shortened via adjuster 142. Similarly, upper grip portion 24 is releasably secured to the same selected arm portion as the lower slide portion 26, being supported by slide strap 144 to the respective selected web portion 106, 108, the assembly depending on whether a right-handed or left-handed swing is being taught, and the slide strap 144 may be provided with an adjuster similar to that of adjuster 142 for the grip strap 140. Further, each strap 140, 144 may be fabricated of material having greater or lesser stretch capacity, as will be apparent to the skilled artisan.

In accordance with the invention, the arm portion 102, 104 associated with the leading arm of golfer G is securely tightened about the wrist of that leading arm, the remaining arm portion securely tightened about the upper arm of the trailing arm. It will be appreciated that each arm portion 102, 104 may be secured independently and then fastened together with the center strap 126, and each arm portion may be retained in position without the center strap during training to enable the golfer to confirm an improved golf swing in conformance with the method of the invention. In use, the desired golf swing is then performed utilizing the fully assembled and installed harness 100. Alternatively, the harness may be utilized independently of the interengaging grip and slide portions, to simulate a golf swing as desired for instructional purposes. In either case, harness 100 secures the trailing arm during the swing, and teaches a relatively constrained position during contact with the golf ball, to and through the follow through teaching the use of built-up momentum provided by the newly taught optimized downstroke.

It is to be understood that the present invention is not limited to the embodiments described above, but encompasses any and all embodiments within the scope of the following claims.

What I claim is:

1. A training aid for aiding a golfer in improving a golf swing, the training aid utilizing a golf club having a handle, an impact head and a shaft, the training aid comprising, in combination:

a gripping portion removably secured adjacent to the golf club handle and a slide portion removably secured to the shaft, wherein the gripping portion includes an outer surface having a relatively low coefficient of friction, and an inner surface having a relatively high coefficient of friction for engaging the golf club handle, the gripping portion fabricated of a single piece of a biaxially stretchable material, the single piece having a pair of lateral opposing edges bounded by axially upper and lower edges, the single piece being removably secured when joined at the opposing lateral edges, and wherein the lateral edges are joined by securing devices selected from the group including a zipper, and cooperative hook-and-loop fastener portions affixed to each of the lateral edges; and a harness dimensioned and configured to secure together both arms of a golfer.

2. The training aid of claim 1, wherein the harness is dimensioned and configured to secure a wrist of a leading arm to an upper arm of a trailing arm of the golfer.

3. The training aid of claim 1, wherein the harness is dimensioned an configured further to secure together both arms of the golfer and the training aid during use thereof.

4. A training aid for aiding a golfer in improving a golf swing, the training aid utilizing a golf club having a handle, an impact head and a shaft, the training aid comprising, in combination: a gripping portion removably secured adjacent to the golf club handle; and a slide portion removably secured to the shaft, wherein the slide portion is fabricated of a single piece of a biaxially stretchable material, the single piece having a pair of lateral opposing edges bounded by axially upper and lower edges; and a harness dimensioned and configured to secure together both arms of a golfer.

5. The training aid of claim 4, wherein the harness is dimensioned and configured to secure a wrist of a leading arm to an upper arm of a trailing arm of the golfer.

6. The training aid of claim 4, wherein the harness is dimensioned an configured further to secure together both arms of the golfer and the training aid during use thereof.

7. The training aid as recited in claim 4, wherein the slide portion includes an inner surface having a relatively low coefficient of friction, and an outer surface having a relatively high coefficient of friction for gripping by the golfer.

8. The training aid as recited in claim 4, wherein in the installed condition an upper aspect of the slide portion telescopingly engages in overlapping fashion a lower aspect of the gripping portion during one phase of the golf swing.

9. The training aid as recited in claim 4, wherein the gripping portion includes a portion for securing at least one digit of the golfer's hand in a preferred position immediately adjacent the golf club handle.

10. The training aid as recited in claim 4, wherein the gripping portion has a truncated frustoconical shape, the larger end thereof encompassing an aspect of the golf club handle.

11. The training aid as recited in claim 4, wherein the gripping portion is fabricated of a single piece of a biaxially stretchable material, the single piece having a pair of lateral opposing edges bounded by axially upper and lower edges.

12. The training aid as recited in claim 11, wherein the single piece is removably secured when joined at the opposing lateral edges.

13. The training aid as recited in claim 12, wherein the lateral edges are joined by securing devices selected from the group including a zipper, and cooperative hook-and-loop fastener portions affixed to each of the lateral edges.

14. The training aid as recited in claim 4, wherein the gripping portion is fabricated of a single, seamless, piece of a biaxially stretchable material.

15. A training aid for aiding a golfer in improving a golf swing, the training aid utilizing a golf club having a handle, an impact head and a shaft, the training aid comprising, in combination: a gripping portion removably secured adjacent to the golf club handle; and a slide portion removably secured to the shaft, wherein the portions are removably secured together with a lanyard; and a harness dimensioned and configured to secure together both arms of a golfer.

16. The training aid of claim 15, wherein the harness is dimensioned and configured to secure a wrist of a leading arm to an upper arm of a trailing arm of the golfer.

17. The training aid of claim 15, wherein the harness is dimensioned an configured further to secure together both arms of the golfer and the training aid during use thereof.

18. The training aid as recited in claim 15, further comprising a removable connection for joining together a lanyard extending from each of a lanyard joining together the gripping portion and the slide portion.

19. The training aid as recited in claim 15, further comprising a lanyard joining together the gripping portion and the slide portion.

* * * * *